US008998209B2

(12) United States Patent
Pockaj

(10) Patent No.: US 8,998,209 B2
(45) Date of Patent: Apr. 7, 2015

(54) ROTATIONAL MOTION DICE GAME SYSTEM

(71) Applicant: Pockaj D.O.O., Kozina (SI)

(72) Inventor: Iztok Pockaj, Lokev (SI)

(73) Assignee: Pockaj D.O.O. (SI)

( * ) Notice: Subject to any disclaimer, the term of this patent is extended or adjusted under 35 U.S.C. 154(b) by 0 days.

(21) Appl. No.: 14/301,638

(22) Filed: Jun. 11, 2014

(65) Prior Publication Data

US 2014/0361485 A1 Dec. 11, 2014

Related U.S. Application Data

(63) Continuation-in-part of application No. 14/171,542, filed on Feb. 3, 2014, and a continuation-in-part of application No. 14/120,329, filed on May 14, 2014.

(60) Provisional application No. 61/833,855, filed on Jun. 11, 2013.

(51) Int. Cl.
*G07F 17/32* (2006.01)
*A63F 9/04* (2006.01)

(52) U.S. Cl.
CPC ..... *A63F 9/04* (2013.01)

(58) Field of Classification Search
CPC ..... A63F 9/0406; A63F 5/04
USPC ..... 463/22; 273/145 C, 145 R
See application file for complete search history.

(56) References Cited

U.S. PATENT DOCUMENTS 1,649,979 A * 11/1927 Rowland et al. ..... 194/293
2,831,692 A * 4/1958 Keast ..... 273/145 E
3,761,091 A * 9/1973 Zohn ..... 273/274
4,941,665 A 7/1990 Klamer
6,769,688 B1 8/2004 Lean
7,874,905 B2 1/2011 Yoshizawa
2002/0163124 A1 11/2002 Weigl
2008/0139281 A1 6/2008 Yoshizawa (Continued)

FOREIGN PATENT DOCUMENTS

MX 2009006840 A * 6/2009 ..... A63F 9/00
WO WO 2008115157 A2 * 9/2008 ..... A63F 9/0406

OTHER PUBLICATIONS

The International Search Report and The Written Opinion—Date of Mailing: Oct. 17, 2014.

(Continued)

*Primary Examiner* — Corbett B Coburn

(74) *Attorney, Agent, or Firm* — Newman Law, LLC

(57) ABSTRACT

A rotational motion dice game system is provided. The system includes a circular surface centered around a central vertical axis. Then, a first driving mechanism is connected to the circular surface and configured to move between a first position and a second position along the central vertical axis. A ring surface is positioned above the circular surface and configured for rotational motion around the central vertical axis. A plurality of bumpers is arranged in a circumference along the ring surface. Finally, a controller is connected to the first driving mechanism and configured to cause the movement of the driving mechanism from the first position to the second position, further causing the movement of the circular surface from the first position to the second position in order to cause the movement of at least one die residing on the circular surface.

10 Claims, 13 Drawing Sheets

(56) References Cited

U.S. PATENT DOCUMENTS

| | | | |
|---|---|---|---|
| 2009/0061981 | A1 | 3/2009 | Smith |
| 2009/0256310 | A1 | 10/2009 | Sanchez |
| 2011/0218027 | A1 | 9/2011 | Manz et al. |
| 2011/0281631 | A1 | 11/2011 | Bontempo et al. |

OTHER PUBLICATIONS

International Search Report and Written Opinion—Date of Mailing: Jun. 25, 2014.

* cited by examiner

ROTATIONAL MOTION DICE GAME SYSTEM

CROSS REFERENCE TO RELATED APPLICATIONS

This application claims priority to U.S. Provisional Application No. 61/833,855 entitled ROULETTE SYSTEM MODIFIED FOR DICE GAMES, filed on Jun. 11, 2013, the entirety of which is incorporated herein by reference.

This application is a Continuation-in-Part of U.S. Non-Provisional application Ser. No. 14/171,542, entitled BINGO GAME SYSTEM WITH ROULETTE FEATURE, filed on Feb. 3, 2014, the entirety of which is incorporated herein by reference.

This application is a Continuation-in-Part of U.S. Non-Provisional application Ser. No. 14/120,329, entitled BINGO GAME SYSTEM WITH MULTIPLE GAME FUNCTIONALITY, filed on May 14, 2013, the entirety of which is incorporated herein by reference.

COPYRIGHT NOTICE

A portion of this disclosure contains material that is subject to copyright protection. The copyright owner has no objection to the facsimile reproduction by anyone of this patent document as it appears in the U.S. Patent and Trademark Office, patent file or records, but reserves all copyrights whatsoever in the subject matter presented herein.

BACKGROUND

The invention is directed to wagering games, and more particularly, dice games typically found in gaming establishments, such as those involving a playing surface, playing positions for multiple players, multiple dice, and a dealer, or virtual representations thereof.

There are many variations of dice-based casino games that have been played for several centuries. Sic-bo, tai sai, dai sui, big and small, hi-lo, grand hazard, and chuck-a-luck are all variations of dice-based games available in casinos today. Sic-bo is an ancient Chinese variation of a wager based dice game involving three dice and a plurality of betting options. Both Grand Hazard and Chuck-a-Luck are English dice game involving two dice. All casino dice games are traditionally played in the same manner involving a felt play-table with a plurality of available bets in some sort of customized design.

In operation of a typical dice game, players place chips or tokens on a betting layout located on a play table with a plurality of wager combinations, and then the croupier or dealer throws the necessary amount of dice in order to determine a winning combination. The dice are usually thrown across the play table, although cages or transparent containers holding the dice may also be used. The dice come to rest and the winning combination of numbers on the dice is displayed. Afterward, the croupier or dealer settles the various wagers placed on the play table layout in accordance with predetermined rules and wager odds and the process is repeated.

Traditional set-ups for dice games require the additional attention of a dealer as well as the reset of the wagers on a play-table once the dice outcomes are determined. Electronic gaming formats for dice games exist, but lack the visual spontaneity of actual dice being used during the game.

Gaming establishments or casinos continually require new game systems to offer their players. Players are typically attracted to games that provide relatively decent odds of winning, as compared with other casino games, and can be played rapidly. It has been found that many of the games which have been successful also offer lively game play features that further serve to heighten player interest in such games. Naturally, casino operators seek to provide the most popular games for their gaming patrons.

Thus, there is a need for systems and methods which resolve one or more of the problems identified above, among other things.

SUMMARY OF INVENTION

The invention is generally directed to wagering games, and more particularly, dice games typically found in gaming establishments, such as those involving a playing surface, playing positions for multiple players, multiple dice, and a dealer, or virtual representations thereof.

Some embodiments of the invention are directed to a rotational motion dice game system. The system includes a circular surface, a first driving mechanism, a ring surface, a plurality of bumpers, and a controller. The circular surface is centered on a central vertical axis. The first driving mechanism is connected to the circular surface and configured to move between a first position and a second position along the central vertical axis. The ring surface is positioned above the circular surface and configured for rotational motion around the central vertical axis. The plurality of bumpers is arranged in a circumference along the ring surface. The controller is connected to the first driving mechanism and configured to cause the movement of the driving mechanism from the first position to the second position, further causing the movement of the circular surface from the first position to the second position in order to cause the movement of at least one die residing on the circular surface.

BRIEF DESCRIPTION OF THE DRAWINGS

Other advantages of the invention will be readily appreciated as the same becomes better understood by reference to the following detailed description when considered in connection with the accompanying drawings.

DETAILED DESCRIPTION OF INVENTION

Figure 1B:
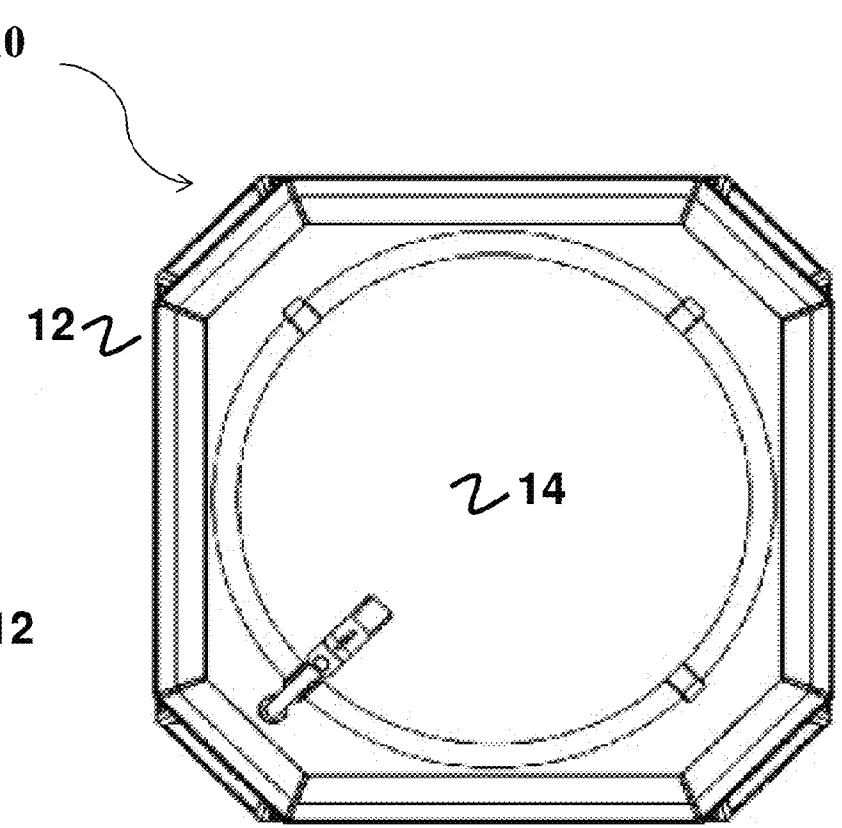
FIG. 1*b* is a top of the rotational dice system.

The exemplary embodiments herein relate to a rotational dice game system. In particular they related to a rotational dice game system that utilizes a playing surface, playing positions for multiple players, multiple dice, and a dealer, or virtual representations thereof.

Some embodiments of the invention are directed to a rotational motion dice game system. The system includes a circular surface, a first driving mechanism, a ring surface, a plurality of bumpers, and a controller. The circular surface is centered on a central vertical axis. The first driving mechanism is connected to the circular surface and configured to move between a first position and a second position along the central vertical axis. The ring surface is positioned above the circular surface and configured for rotational motion around the central vertical axis. The plurality of bumpers is arranged in a circumference along the ring surface. Finally, the controller is connected to the first driving mechanism and configured to cause the movement of the driving mechanism from the first position to the second position, further causing the movement of the circular surface from the first position to the second position in order to cause the movement of at least one die residing on the circular surface.

In some embodiments, the game further includes a second driving mechanism connected to the ring, the second driving mechanism configured to provide rotational motion to ring surface.

In some embodiments, the game further includes a third driving mechanism connected to the circular surface, the third driving mechanism configured to provide rotational motion to the circular surface.

In some embodiments, the controller is further configured to cause the first and third driving mechanisms to reach a desired speed in order to assist in the moving action of the at least one die residing on the circular surface.

In some embodiments, the controller is connected to the second driving mechanism and is further configured to coordinate the activity of the first, second, and third driving mechanisms in order to cause the movement of at least one die residing on the circular surface.

In some embodiments, the controller is further configured to randomly generate a number. The number is then used by the controller to regulate the motion generated by first driving mechanism in order to cause the movement of at least one die residing on the circular surface.

In some embodiments, the controller is further configured to randomly generate a number. The number is then used by the controller to regulate the motion generated by second driving mechanism in order to cause the movement of at least one die residing on the circular surface.

In some embodiments, the game further includes a pedestal positioned along the central vertical axis. The pedestal is configured to rotate around the central axis and the controller is further configured to coordinate the activity of the first, second, and third driving mechanisms in order to cause the movement of at least one die residing on the circular surface.

In some embodiments, the game further includes a transparent wall around the outer edge of the ring surface, the transparent wall configured to maintain the at least one die on the circular surface.

In some embodiments, the transparent wall further comprises a dome enclosure over the circular and ring surfaces and central vertical axis.

In some embodiments, one or more illumination devices may be mounted within the lighting pedestal dice game and positioned to direct illumination radially outward.

In some embodiments, the controller is further configured to control the illumination, to attract play or so that certain colors may be illuminated to indicate game play status, such as when wagers are permitted, or to indicate the winning outcome.

The invention may be combined with a live game that includes one or more remote kiosks or gaming stations. Each station is configured to receive and determine wagers based on one or more live games played at a nearby or remote location. The system is therefore configured to include devices which monitor the one or more live games, such as a rotational dice game presented within the current invention, in which other gaming elements are activated or employed, and collect the game play data from each of the games.

In some embodiments, the game play data is manually entered for collection by the system. The game play data collected is transmitted to the terminals and used to determine the outcome of wagers placed at the terminals. The stations may be any apparatus or device capable of receiving and transmitting data, including devices which either process game play data or do not process game play data, including "thin-client" or "smart" devices. The stations present the live game information for each of the live games on a display device and further include a data input device for facilitating the entry of wagers. Thus, players interested in placing wagers on a live game are not confined to a single location or even the casino floor as the games continue.

It should be understood that each of the methods and individual steps recited herein may be partially or wholly carried out in a variety of ways and/or systems, which may include, but are not limited to, an electronic gaming machine (EGM) for use by one or more players, a multiplayer platform which may include a player interface such as a touchscreen display and involve physical or virtual game symbols, a home computer and/or portable computing device, such as a tablet computer or mobile phone capable of communicating with a network or over the Internet, global telecommunication network or world wide web.

It should further be understood that the invention is directed to, among other things, methods of providing, conducting and resolving wagering games that include a sequence of controlled and concrete transformative events. Some of these events may involve communications between computing components, indicating preferences, placing wagers, debiting and awarding credits stored in an account, the generation of random data and results for one or more players, the application of randomly-generated data to resolve wagers, the pooling of all wagers placed, the determination of wager outcomes in accordance with preset outcome determining criteria, and the notification of such outcomes along with the designation of a portion of the wager pool for each player and simulated roulette game outcome. The generation of random data may be facilitated by computerized and/or physical implements, such as a random number generator. The transformative events may also include parsing of the data for comparative purposes with preset criteria to determine an outcome in the underlying bingo game.

Selected exemplary embodiments of the invention will now be explained with reference to the drawings. It will be apparent to those skilled in the art from this disclosure that the following description of exemplary embodiments of the invention is provided for illustration only and not for the purpose of limiting the invention as defined by the appended claims and their equivalents.

Referring to the figures, where like numerals indicate like or corresponding parts throughout the several views, systems and methods of the invention which are configured to cooperate with another in order to provide a bingo game with a roulette feature are described.

System Generally

Figure 1A:
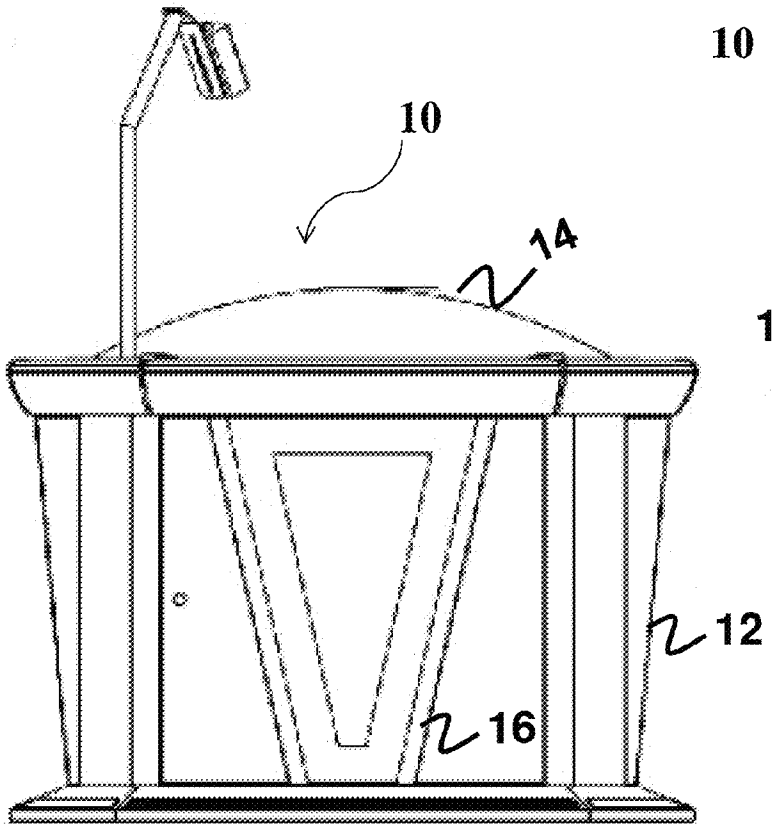
FIG. 1*a* is a side view of the rotational dice system including the present invention.

FIGS. 1*a* and 1*b* are side and top views of the rotational dice system 10, according to an embodiment of the present invention. The system 10 is housed in a cabinet 12 that incorporates all the elements necessary for the function of the system. Additional elements may be in communication with the system by way of access ports and wireless communication accessible through the cabinet 12. These methods of communication will be discussed in further detail below.

Each cabinet 12 includes a service door 16 in order to access the internal components of the system 10.

Also, a dome enclosure 14 sits atop the cabinet 12 in order to allow user to view the internal components of the system 10. The purpose of the dome enclosure is to ensure that the dice used to display the outcome remain on the circular surface 20 and the ring surface 18. In some other embodiments the dome enclosure 14 may also be a partial enclosure and be in the form of a partial, curved, transparent wall. This partial enclosure would allow access to the circular surface as well as the dice for additional interaction with the rotational dice system 10.

Figure 2:
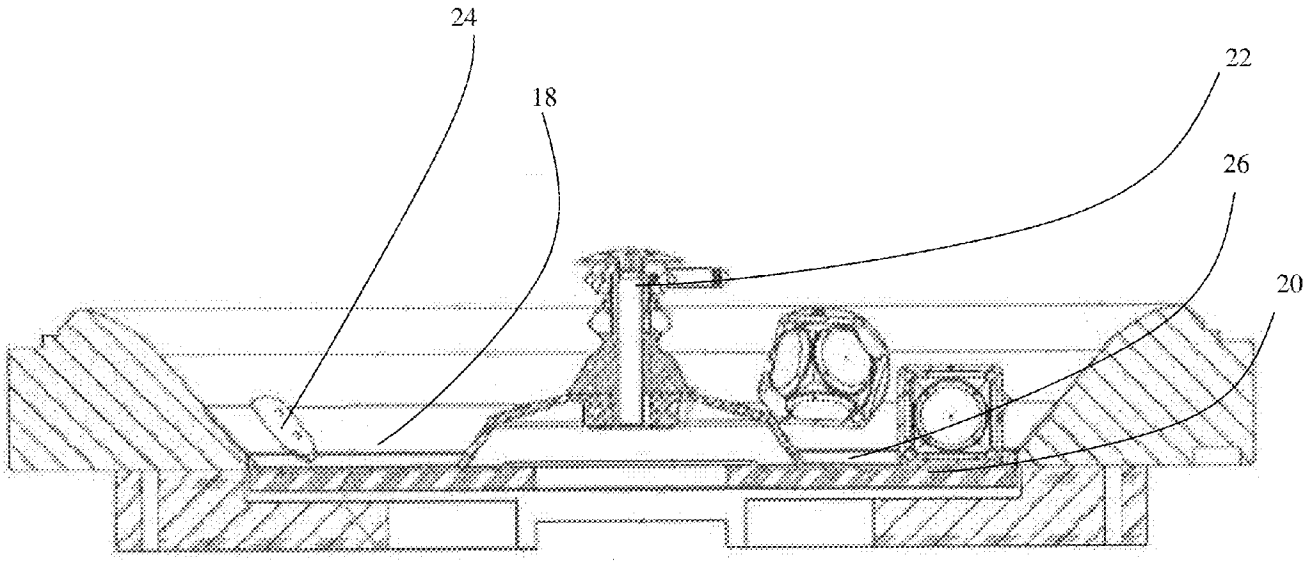
FIG. 2 is cross section of the internal system components.
Figure 3:
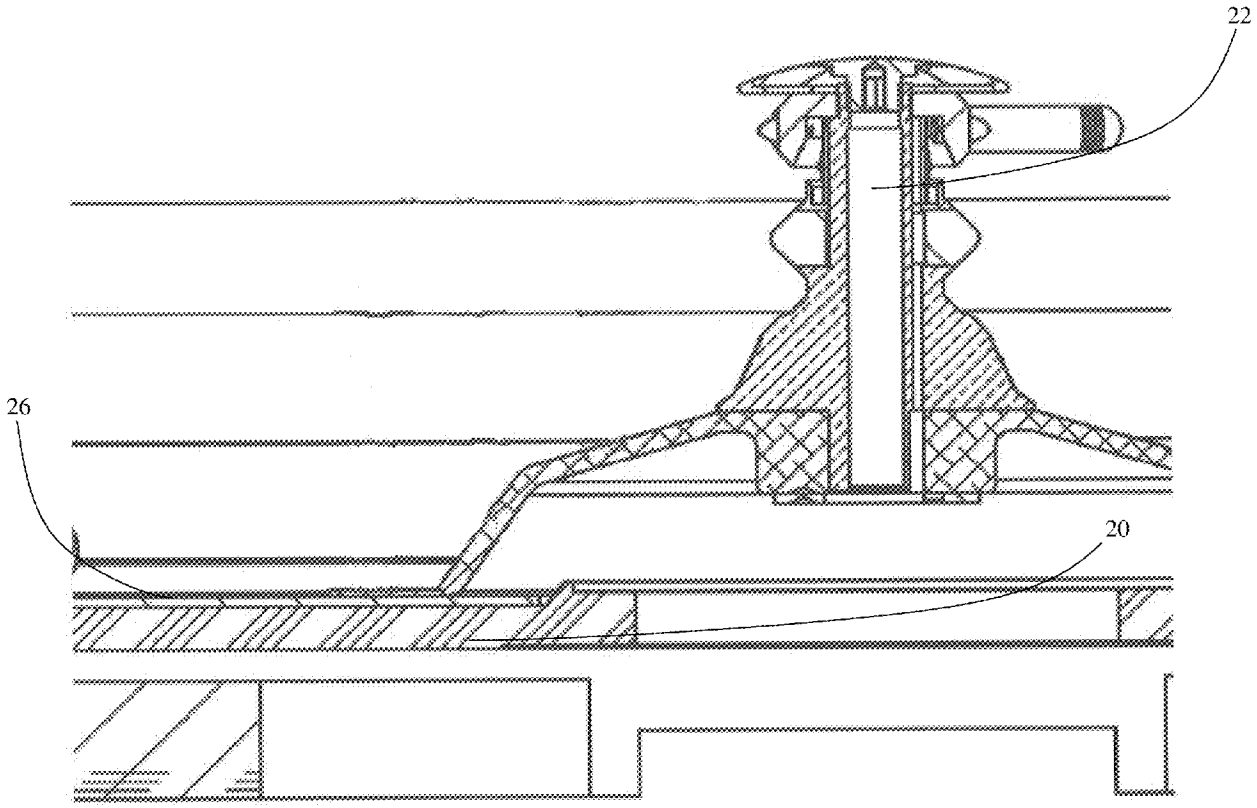
FIG. 3 is a zoom in of the cross section view showing in FIG. 2.

FIGS. 2 and 3 are illustrative drawings of a cross section of the internal components of the system 10. A user looking through the dome enclosure 14 will look and see a functioning interactive rotational dice system within the cabinet 12. Looking at FIG. 2 a user will see the primary visual components of the system 10 including the ring surface 18, the circular surface 20, the lighting pedestal 22, and the plurality of bumpers 24.

The ring surface 18 is configured sit above the circular surface 20 and has a plurality of bumpers 24. The ring surface may be static, allowing dice to bounce off the plurality of bumpers 24 as the circular surface 20 rotates about the central axis. The ring surface 18 provides the necessary angled surface to generate the rolling motion for the dice within the system 10.

The some embodiments the ring surface 18 is configured to also rotate about the central axis. It may be configured to rotate in the same direction as the circular surface or counter to the circular surface 20. The speed of rotation for the ring surface 18 may be regulated by the controller 28 in order to modify the timing between wagers and outcomes.

The circular surface 20 is configured to either rotate about the central axis, change vertical position along the central axis, or both. In some embodiments the circular surface 20 rotates about the central axis in order to cause the rolling of dice and generate an outcome. Other embodiments alternatively switch from a first position to a second position along the central axis. This dropping and raising movement causes the dice to tumble and also generate an outcome. Both the vertical movement and rotation can be combined in order to generate the natural tumbling of the dice within the system 10. This can also be combined with the rotation of the ring surface 18 in order to generate an outcome. The circular surface may also have a pattern in order to customize the game appearance or provide additional mechanics as needed.

At the center of the circular surface there is also a lighting pedestal 22. The lighting pedestal 22 is also configured to rotate about the central axis during game play. The lighting pedestal may also be configured with additional LED lights 40 in order to light the circular surface 20 and provide additional game elements and signals (discussed further below). The lighting pedestal 22 may also be configured along with the controller 28 to initiate the spinning of the circular surface 20 and the ring surface 18.

The ring surface 18 also has a plurality of bumpers 24. The bumpers 24 serve as points of contact for the tumbling dice within the system 10 in order to better generate a natural tumbling appearance for the dice in the system. The bumpers may also be configured with LED lights 40 in order to provide additional game signals to the system 10.

Figure 4:
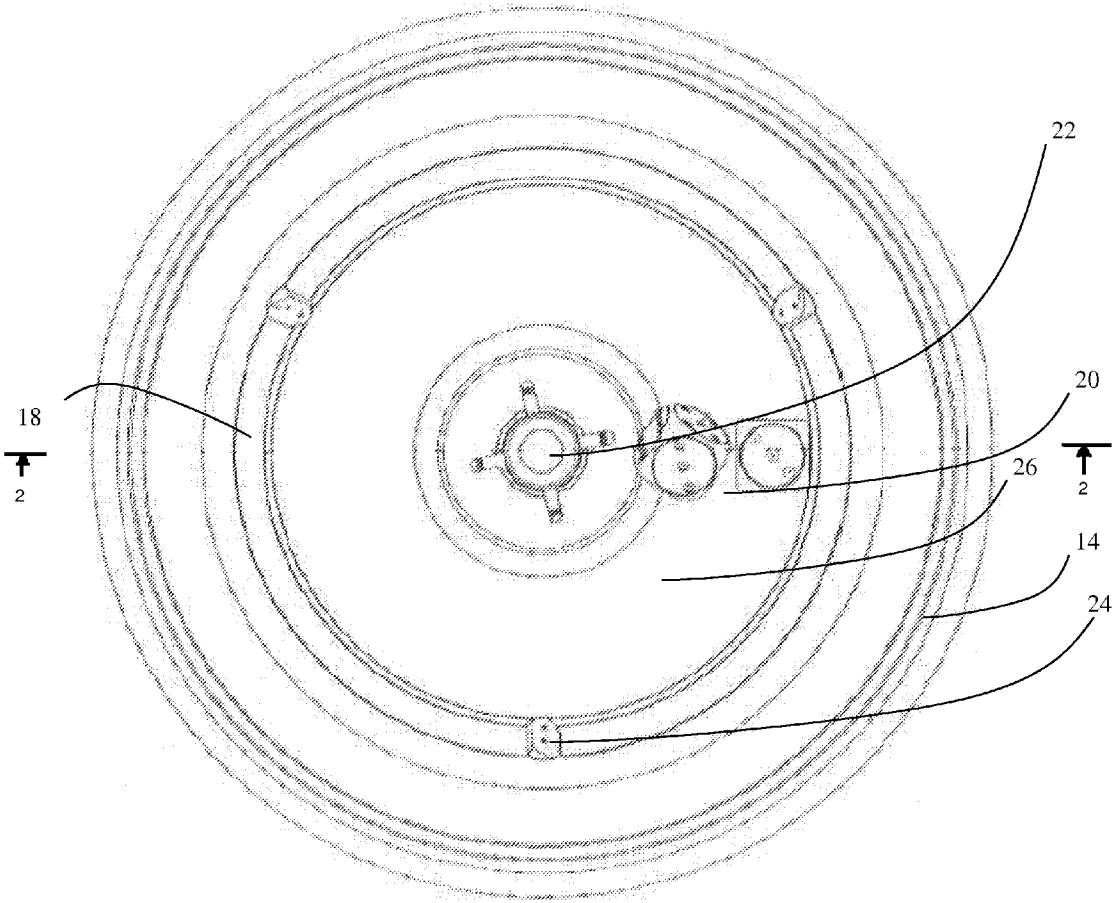
FIG. 4 is a top view of the internal rotational dice components within the system.

FIG. 4 is a top view of the internal components of the system 10 viewed by a user during game play. In addition to the components identified above, the system 10 also includes a plurality of sensors 26 incorporated into the circular surface 20. The sensors 26 register when the dice are finished tumbling and may also be configured to read the outcome of the dice within the system 10.

Figure 5:
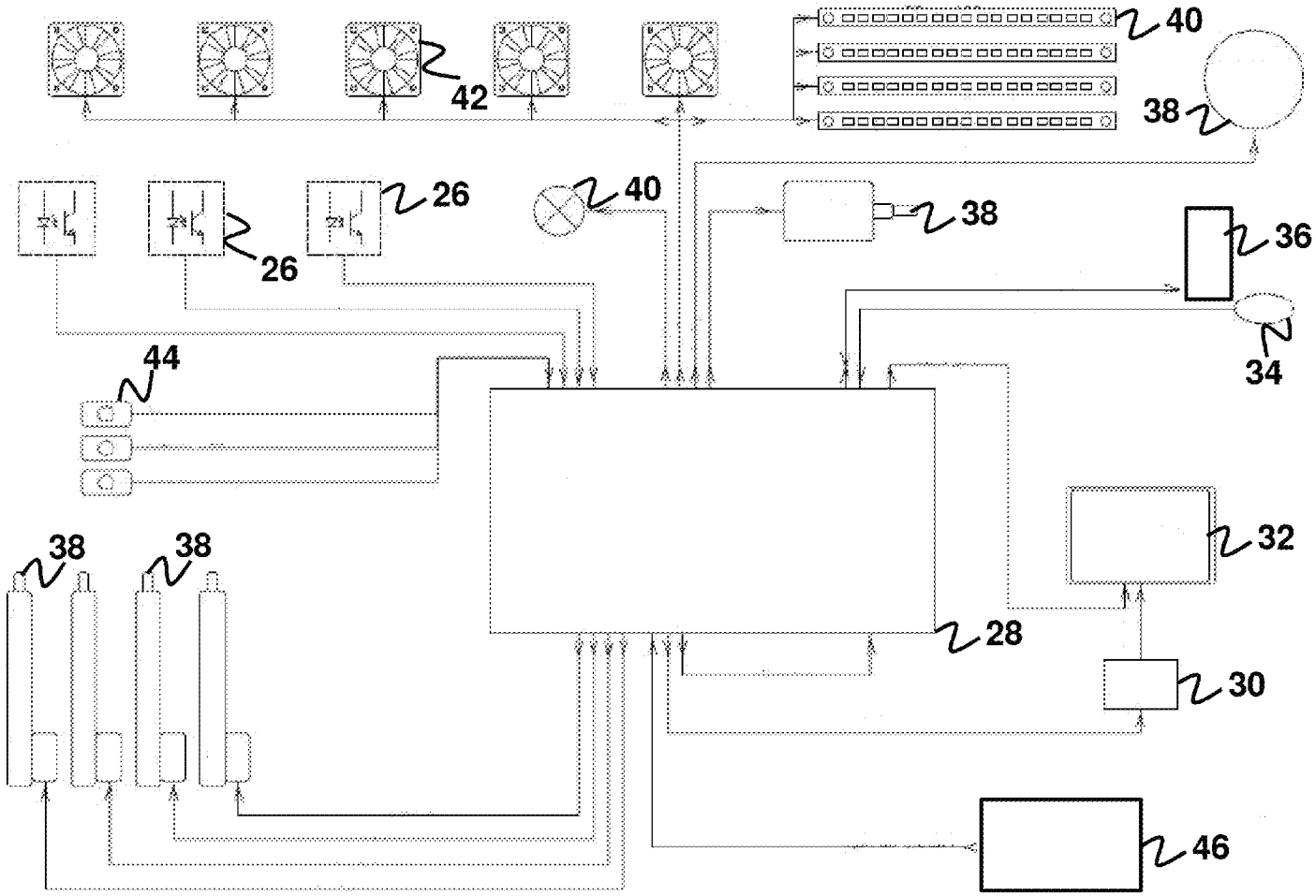
FIG. 5 is a schematic view of the internal components within the system.

FIG. 5 is a diagram of the internal schematic of the system 10. These components are utilized in conjunction with the additional elements of the system 10 in order to initiate and complete the rounds of game play within the system 10. The first component presented within FIG. 5 is the controller 28, which coordinates all of the other components within the system 10 in order to initiate and reset game play. The controller 28 may be within the cabinet 12 but may also reside as an external component as well.

The system 10 also includes a power supply 30, which provides electricity to all the components within the system 10. A display device 32 is utilized in order to run diagnostics and view any necessary information related to the function of the system 10. An alternate input device 34 may be used to manipulate the information presented on the display device 32 and initiate service instruction necessary for the initiation and service of the system 10. Examples of an alternate input device 34 may include any input device common with a general use personal computer including a keyboard, mouse, and/or a tactile input interface integrated into the display device 32.

A network interface device 36 connects the system 10 with other network devices in order to allow a user to interact with the system 10. The network interface device may allow for both wired and wireless connections depending on the needs of the network set up for game play. The integration of the system 10 within a networked environment will be discussed further below.

The system 10 also contains a plurality of driving mechanisms 38. Each driving mechanism may be either a lifting (generating vertical movement) motor or a rotating motor and may be used to drive the individual components of the system 10. A plurality of driving mechanism 38 may be used in tandem through coordination by the controller 28 in order to generate the desired mechanics and tumble the dice during gameplay.

A plurality of LED lights 40 is used by the system 10 in order to illuminate the various portions of the system 10 and drive the illumination system 50 of the invention. A plurality of fans 42 are used to maintain the temperature of the system during operation and game play.

A plurality of sensors receivers 44 coordinate with the plurality of sensors 26 on the circular surface 20 in order to initiate and coordinate game play within the system 10. The plurality of switches 46 regulate access to the various areas of the system 10 (i.e. the service door 16 and the dome enclosure 14).

Finally, an RNG 48 may be used by the system 10 in order to generate variations of mechanical movement with the driving mechanisms 38. This will create variable forms of tumbling for the dice within the system and allow for more entertaining gameplay for the users.

Figure 6A:
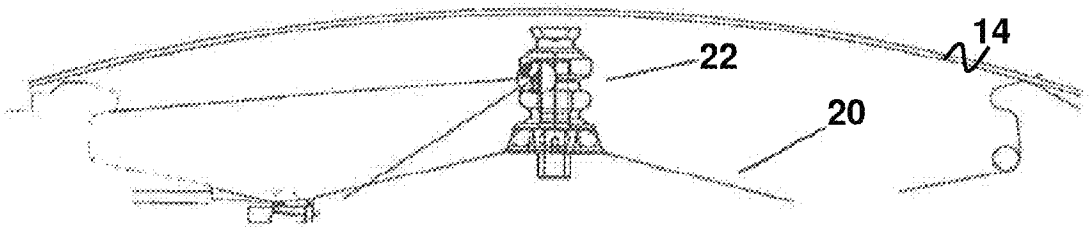
FIG. 6*a* is an additional cross-sectional view of rotational dice feature within the system.
Figure 6B:
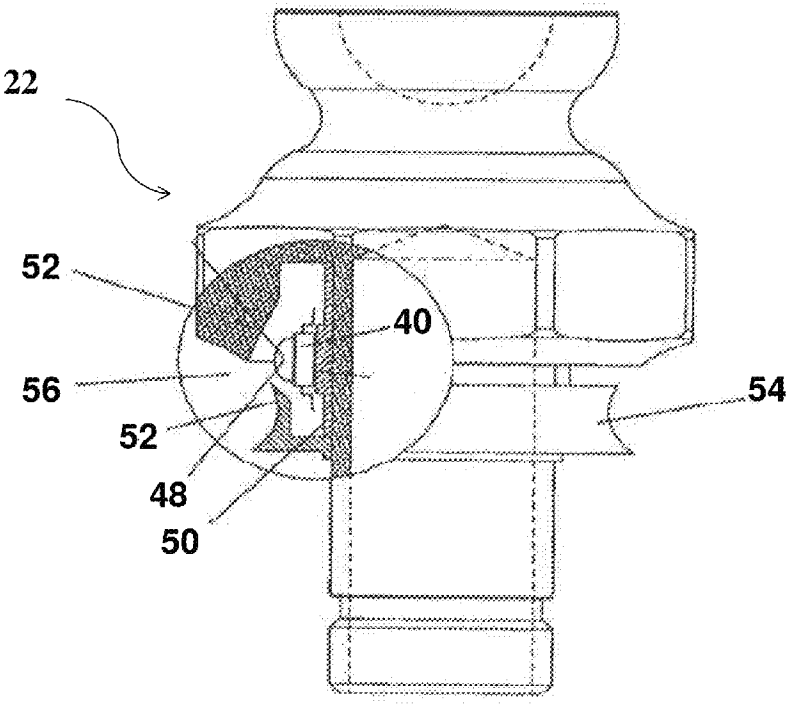
FIG. 6*b* is a zoom-in of the lighting pedestal included within an embodiment of the present invention.

FIGS. 6*a* and 6*b* show an embodiment of the system 10 that includes an illumination system 50. The illumination system 50 may be used in order to initiate and generate game play and features related to game play through the use of the plurality of LEDs 40. FIG. 6*b* shows a zoom in of the lighting pedestal 22 that incorporates the illumination system 50. Attached to the lighting pedestal 22 is an LED holder 52, which is configured to hold a plurality of LEDs 40. The holder 52 and the lighting pedestal 22 are configured have a plurality of edges 54 that ensure that the LEDs 40 display light on both the ring surface 18 and the circular surface 20 through an opening 58.

The illumination system 50 may be used to indicate elements of the game, such as the start of a game, the conclusion of a game, etc. The illumination system 50 may also indicate a game outcome by illuminating the dice on the circular surface 20.

Networked System Generally

Figure 7:
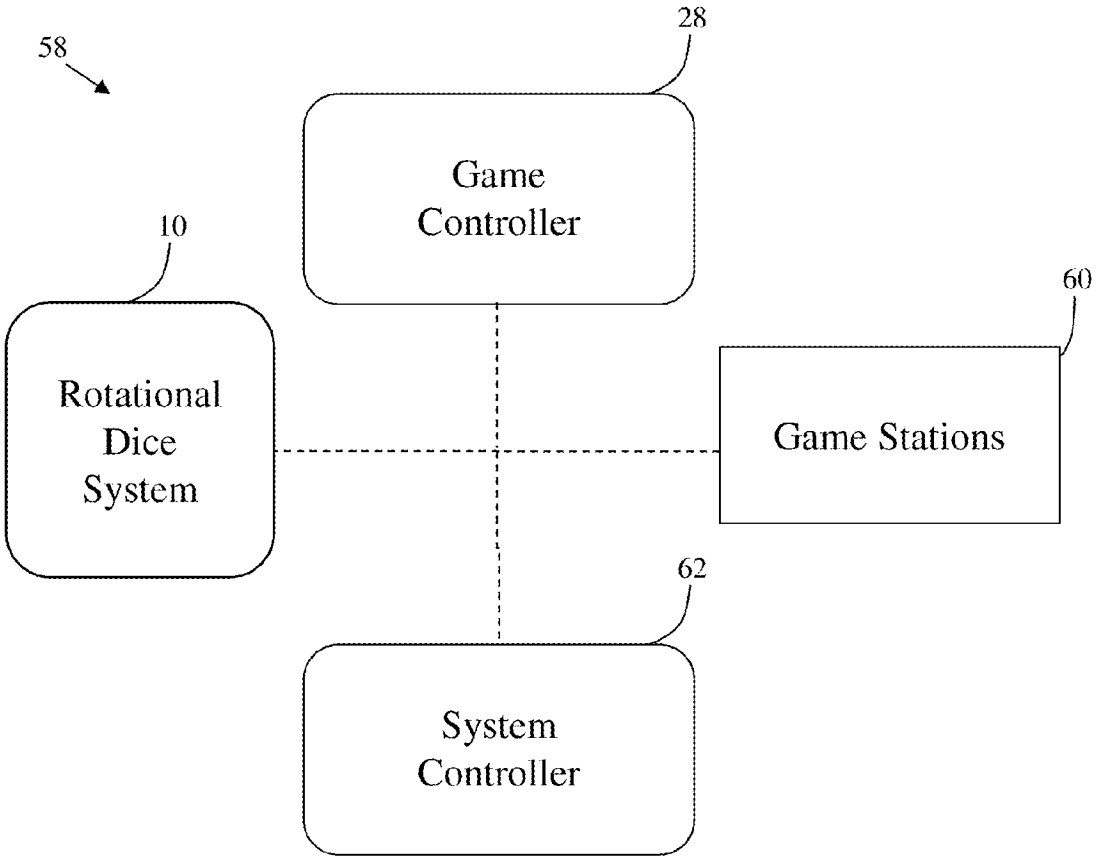
FIG. 7 is a diagram of a network system including an embodiment of the present invention.
Figure 8:
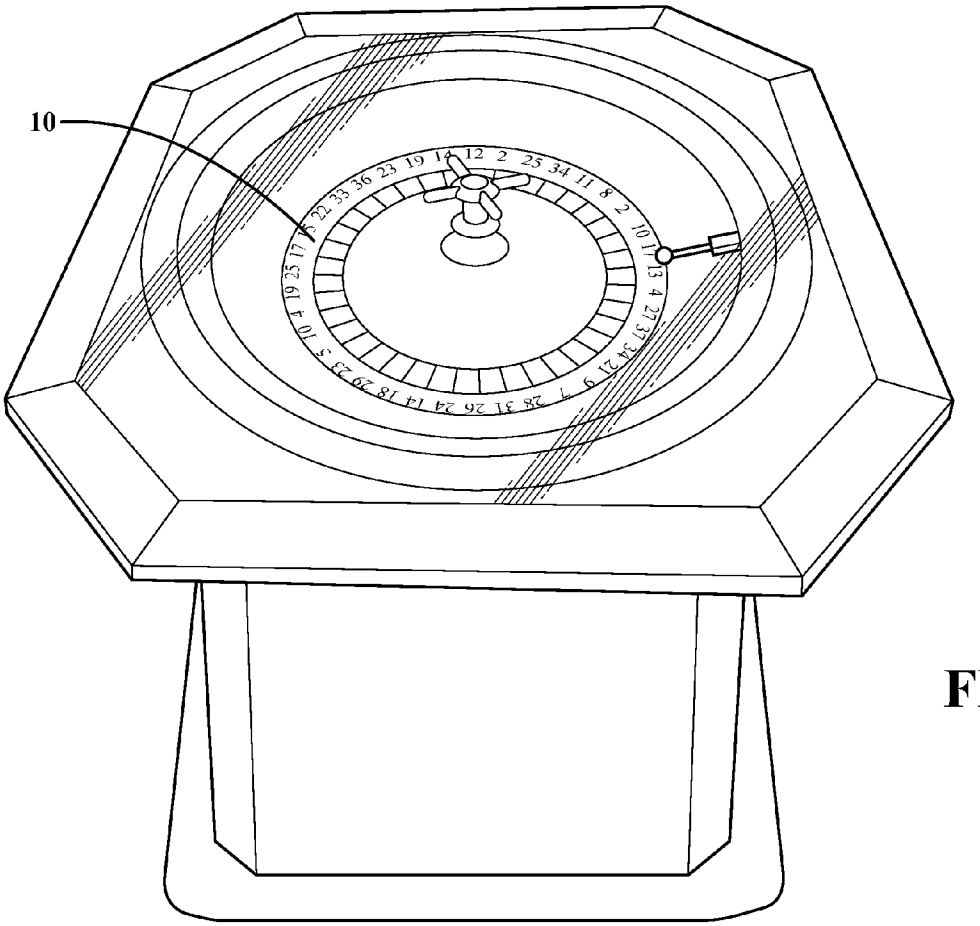
FIG. 8 through 13 illustrate various embodiments of the invention.
Figure 9:
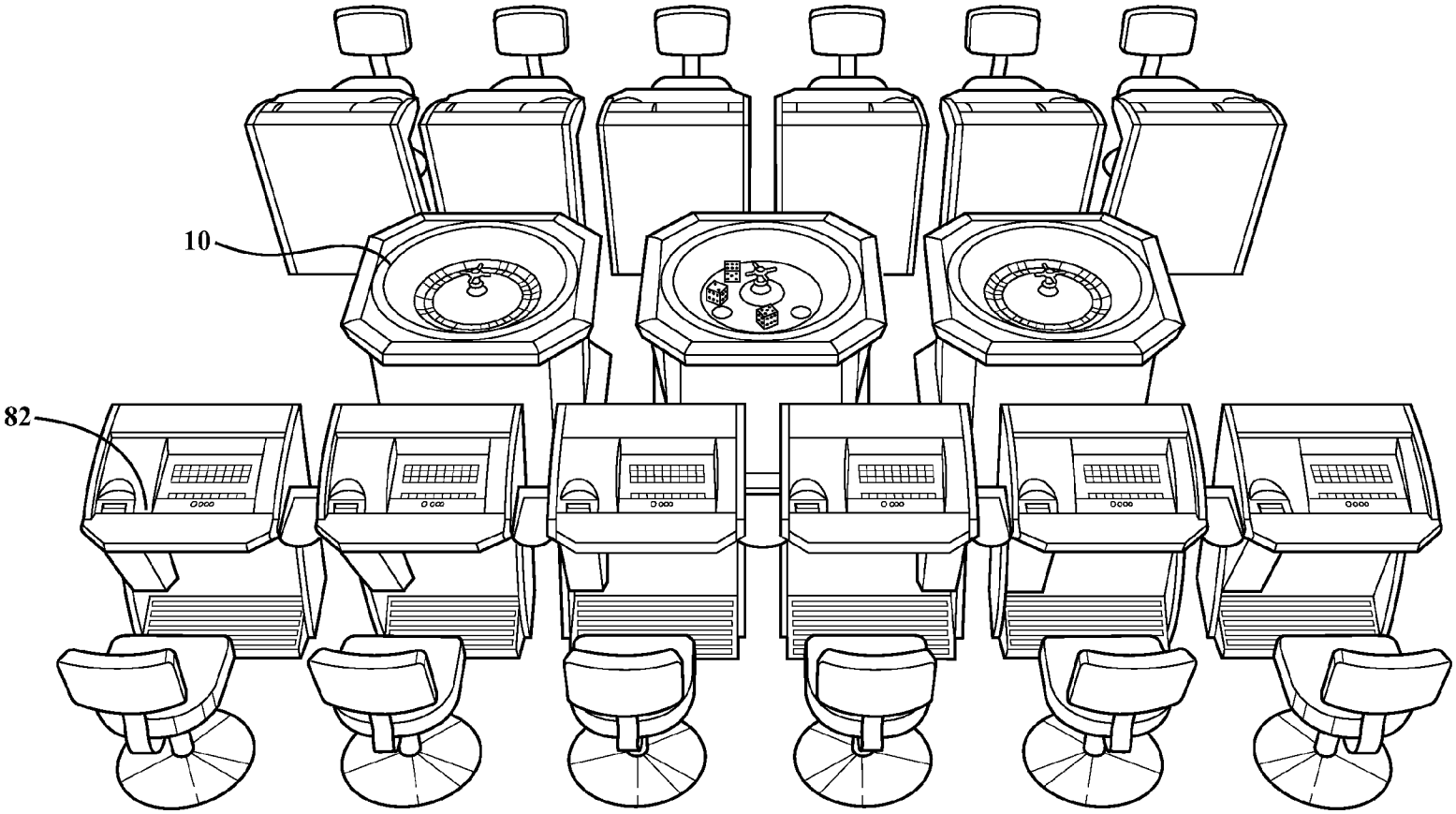
Figure 10:
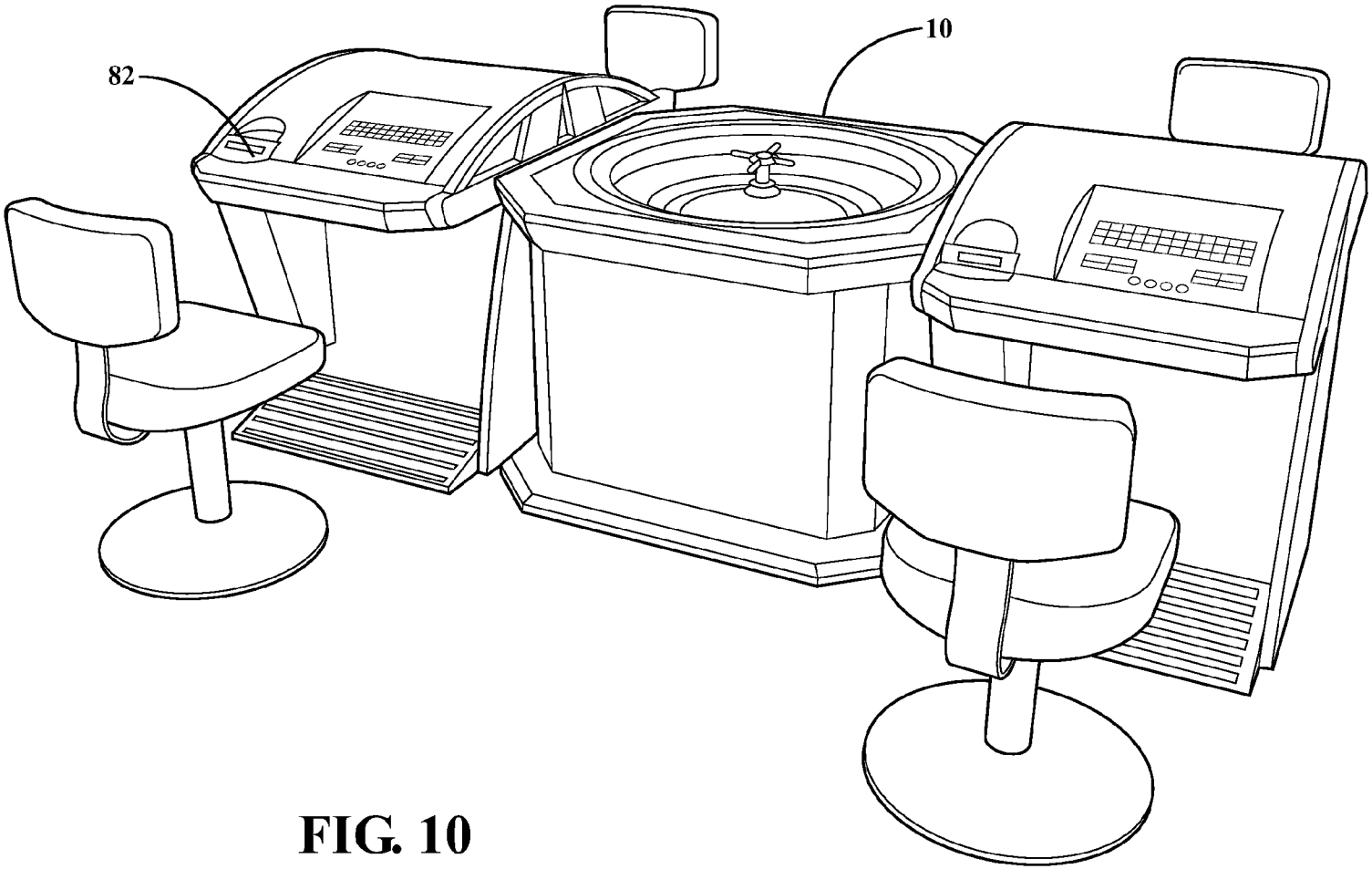
Figure 11:
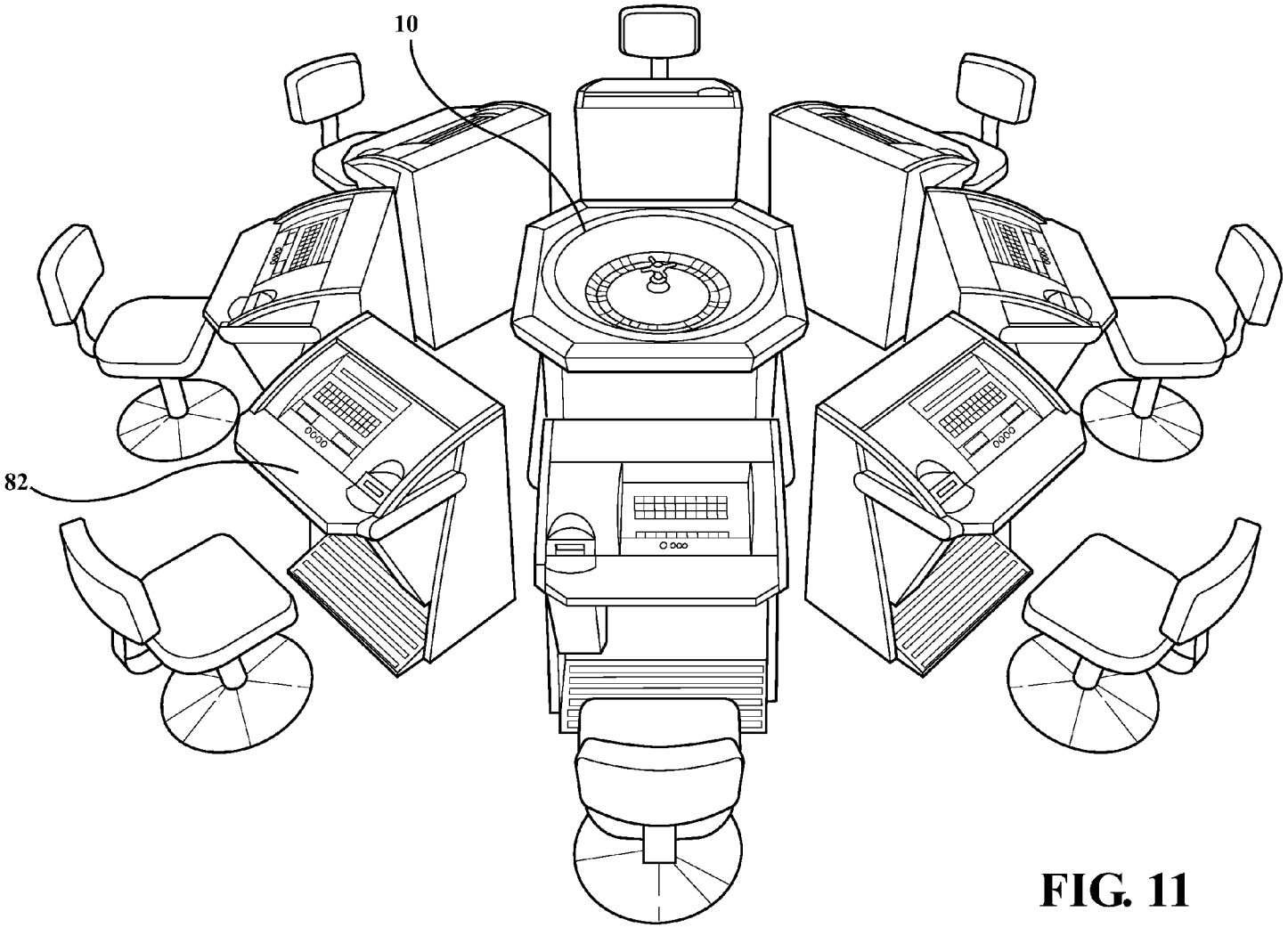

Referring to FIG. 7, a networked system 60 comprises one or more game stations 62, a controller 28, a system controller 64 and a system 10. These components may be housed in a unitary housing or remotely positioned with respect to each other, while remaining in communication. Communication between these components may be facilitated by data communication devices connected over a wired or wireless network, using any conventional digital communication devices that are appropriate based on the locations of the system components.

Each of the game stations 62 is used by the players in order to interact with the system 10 and initiate game-play. Game stations 62 can take the form of player positions in a multi-player platform, electronic game machine cabinets or remote kiosks, but are not limited to such designs and may also be provided on smartphones, mobile computing devices, thin terminal devices, non-smartphone-type cellphones, tablets, laptops, or any other device configured to communicate within system 10. In some embodiments, game stations 82 include player input devices, such as keypads and display devices, or touchscreen displays, bill or ticket acceptors and printers, etc.

In some embodiments the system 10 incorporates a game station 62, a player input device, a communication device, and a controller. The game station includes a display device configured to display a user interface with a plurality of game options available for selection. Each game option is associated with a game play presentation, with at least one game options being a live rotational dice game. The player input device is in communication with the display device and receives selected game options, wherein game play presentations are displayed simultaneously on the display device responsive to the player selected game options. The communication device receives independent game data randomly generated for each of the selected game options. Finally, the controller processes the independent game data received by the communication device for each of the selected game options and facilitating independent game play presentations on the display device as a function of the independent game data.

Industrial Application

FIGS. 8 through 13 show multiple exemplary embodiments of the invention, including embodiments of game stations and live game features, which illustrate various industrial applications of the invention, among other things.

Figure 12:
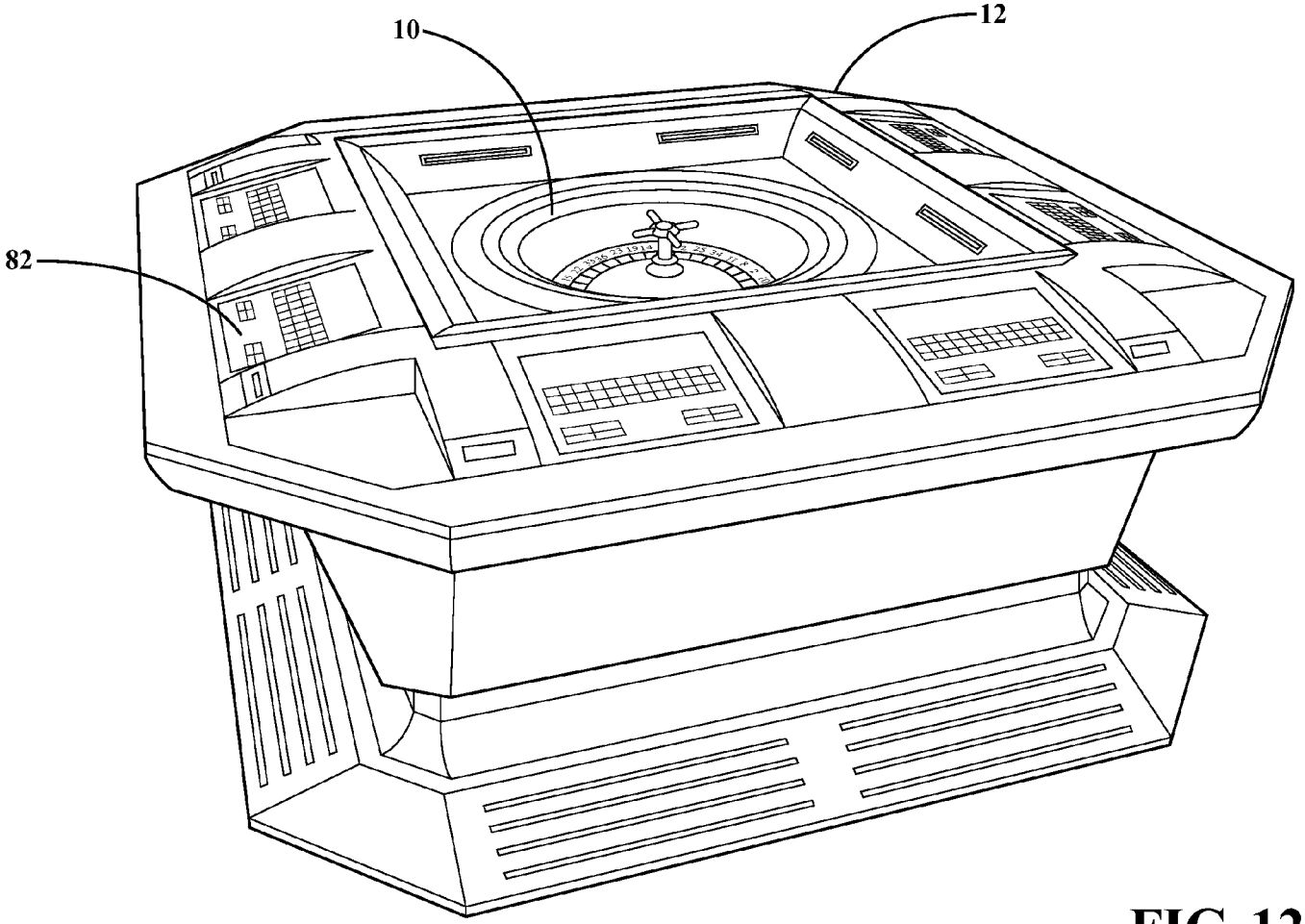
Figure 13:
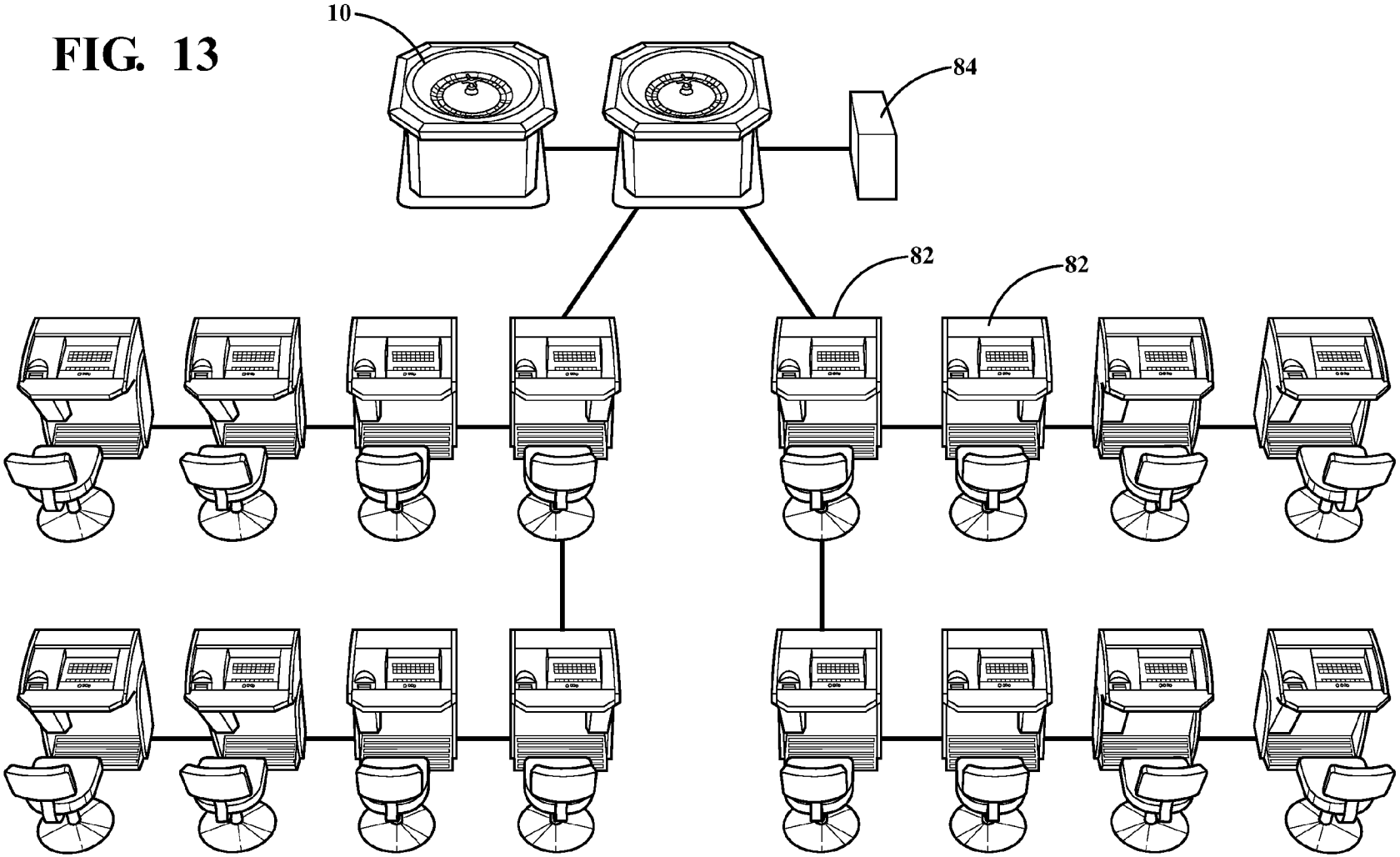

Particularly, FIG. 12 demonstrates an industrial application of the invention that integrates a system 10 with a game station 62 into one cabinet 12.

General Considerations

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. The terms used herein, such as modules like display module, betting module, award module, servers, etc., are for ease in describing and illustrating features and operations of the invention and are not to be considered limiting in any way. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Those skilled in the art will readily appreciate that the systems and methods described herein may be a standalone system or incorporated in an existing gaming system. The system of the invention may include various computer and network related software and hardware, such as programs, operating systems, memory storage devices, data input/output devices, data processors, servers with links to data communication systems, wireless or otherwise, and data transceiving terminals. It should also be understood that any method steps discussed herein, such as for example, steps involving the receiving or displaying of data, may further include or involve the transmission, receipt and processing of data through conventional hardware and/or software technology to effectuate the steps as described herein. Those skilled in the art will further appreciate that the precise types of software and hardware used are not vital to the full implementation of the methods of the invention so long as players and operators thereof are provided with useful access thereto, either through a mobile device, gaming platform, or other computing platform via a local network or global telecommunication network.

Although specific features of various embodiments of the invention may be shown in some drawings and not in others, this is for convenience only. In accordance with the principles of the invention, any feature of a drawing may be referenced and/or claimed in combination with any feature of any other drawing.

While exemplary systems and methods in accordance with the invention have been described herein and in the accompanying materials, it should also be understood that the foregoing along with the accompanying materials are illustrative of a few particular embodiments as well as principles of the invention, and that various modifications can be made by those skilled in the art without departing from the scope and spirit of the invention. Therefore, the described embodiments should not be considered as limiting of the invention in any way. Accordingly, the invention embraces alternatives, modifications and variations which fall within the spirit and scope of the invention as set forth in the claims, including equivalents thereto.

What is claimed is:

1. A rotational motion dice game comprising:

a circular surface, the circular surface centered on a central vertical axis;

a first driving mechanism connected to the circular surface, the driving mechanism configured to move between a first position and a second position along the central vertical axis;

a ring surface positioned above the circular surface, the ring configured for rotational motion around the central vertical axis;

a plurality of bumpers arranged in a circumference along the ring surface; and a controller, the controller connected to the driving mechanism and configured to cause the movement of the first driving mechanism from the first position to the second position, further causing the movement of the circular surface from the first position to the second position in order to cause the movement of at least one die residing on the circular surface;

further including a second driving mechanism connected to the ring, the second driving mechanism configured to provide rotational motion to ring surface.

2. The rotational motion dice game, as in claim 1, the game further including a third driving mechanism connected to the circular surface, the third driving mechanism configured to provide rotational motion to the circular surface.

3. The rotational motion dice game, as in claim 1, the controller further configured to cause the first and third driving mechanisms to reach a desired speed in order to assist in the moving action of the at least one die residing on the circular surface.

4. The rotational motion dice game, as in claim 1, wherein the controller is connected to the second driving mechanism and further configured to coordinate the activity of the first, second, and third driving mechanisms in order to cause the movement of at least one die residing on the circular surface.

5. The rotation motion dice game, as in claim 1, the controller further configured to randomly generate a number, the number then used by controller to regulate the motion generates by first driving mechanism in order to cause the movement of at least one die residing on the circular surface.

6. The rotation motion dice game, as in claim 1, the controller further configured to randomly generate a number, the number then used by the controller to regulate the motion generated by second driving mechanism in order to cause the movement of at least one die residing on the circular surface.

7. The rotation motion dice game, as in claim 1, the controller further configured to randomly generate a number, the number then used by controller to regulate the motion generates by third driving mechanism in order to cause the movement of at least one die residing on the circular surface.

8. The rotation motion dice game, as in claim 1, the game further including a pedestal positioned along the central vertical axis, the pedestal configured to rotate around the central axis and the controller further configured to coordinate the activity of the first, second, and third driving mechanisms in order to cause the movement of at least one die residing on the circular surface.

9. The rotation motion dice game, as in claim 1, the game further including a transparent wall around the outer edge of the ring surface, the transparent wall configured to maintain the at least one die on the circular surface.

10. The rotation motion dice game, as in claim 9, wherein the transparent wall further comprises a dome enclosure over the circular and ring surfaces and central vertical axis.

* * * * *